US007216654B2

(12) United States Patent
Kang

(10) Patent No.: US 7,216,654 B2
(45) Date of Patent: May 15, 2007

(54) DISHWASHER

(75) Inventor: Myung Ho Kang, Busan (KR)

(73) Assignee: LG Electronics Inc., Seoul (KR)

( * ) Notice: Subject to any disclaimer, the term of this patent is extended or adjusted under 35 U.S.C. 154(b) by 565 days.

(21) Appl. No.: 10/721,739

(22) Filed: Nov. 26, 2003

(65) Prior Publication Data

US 2004/0163686 A1 Aug. 26, 2004

(30) Foreign Application Priority Data

Nov. 28, 2002 (KR) ..... 10-2002-0074988

(51) Int. Cl.

| | |
|---|---|
| ***B08B 3/00*** | (2006.01) |
| ***F24D 1/00*** | (2006.01) |
| ***F24D 1/02*** | (2006.01) |
| ***F24D 19/00*** | (2006.01) |

(52) U.S. Cl. ..... 134/58 DL; 134/44; 134/52; 134/58 D; 134/90; 134/102.1; 134/105; 237/9 R; 237/68

(58) Field of Classification Search ..... 134/58 D, 134/105, 90, 102.1, 44, 52, 58 DL; 234/9 R, 234/68

See application file for complete search history.

(56) References Cited

FOREIGN PATENT DOCUMENTS

JP H-03-143419 * 6/1991

* cited by examiner

*Primary Examiner*—Michael Barr
*Assistant Examiner*—Rita R. Patel
(74) *Attorney, Agent, or Firm*—Ked & Associates, LLP

(57) ABSTRACT

A dishwasher having a dishwasher is provided in which an intake port cover for closing a steam intake port is mechanically operated. The dishwasher has a cavity enclosed in part by a door, and a fan motor which drives a fan installed at an upper portion of the door. During a drying operation, the fan generates a suction force to draw steam from the cavity through an intake port of the fan housing and out through an exhaust port. An intake port cover is movably installed with respect to the intake port so as to open and close the steam intake port based on an operation mode of the fan. The intake port cover has a central shaft coupled to a rotational shaft of the fan such that a driving force generated by the fan as it rotates is transferred to the intake port cover so as to selectively open and close the steam intake port. The steam intake port is open during a drying operation, and is closed during a washing and rinsing operations.

19 Claims, 5 Drawing Sheets

DISHWASHER

This application claims the benefit of Korean Application No. 10-2002-0074988 filed on Nov. 29, 2002, which is hereby incorporated by reference.

BACKGROUND OF THE INVENTION

1. Field of the Invention

The present invention relates to a dishwasher having a steam discharger including a fan motor for forcibly discharging steam, and more particularly, to such a dishwasher in which the steam discharger is provided with a mechanically controllable intake port cover, which interoperates with the fan motor.

2. Discussion of the Related Art

Generally speaking, a dishwasher is provided with a heater for performing the drying of dishes and the like immediately following a washing step. Drying is accomplished by heating air to be circulated within a cavity where the dishes are placed by a user. As an inherent byproduct of drying wet dishes, the water is converted into steam, which is discharged from the cavity to facilitate the drying action. Thus, a general dishwasher is provided with a fan and fan motor for forcibly discharging the steam, which are provided as part of a steam discharger communicating between an upper point of the cavity and the exterior of the dishwasher. The steam discharger is typically installed within the dishwasher's door.

Referring to FIG. 1, illustrating a dishwasher according to a related art, a washtub 4 is formed as a substantially hexahedral cavity in which sliding rack 8 is mounted. The washtub 4 is installed in a body 2 having an open front where a hinged door 6 is provided to close the cavity. A steam discharger 30 is installed in an upper portion of the door 6, to discharge steam generated by the drying of dishes and the like.

The steam discharger 30 is comprised of a fan housing 32 one end of which communicates with the cavity at a steam intake port 32*a* and the other end of which penetrates the outer surface of the door 6 at a steam exhaust port 32*b*; an intake port cover 36, coupled to one end of a shaft 36*a*, for selectively opening and closing the steam intake port; and an electromagnet 38, disposed at the other end of the shaft, for controllably operating the intake port cover via the shaft through a hole 32*h* provided in the fan housing. Thus, the electromagnet 38 of the steam discharger 30 is installed on the exterior of the fan housing 32. A fan motor (not shown) is installed in the fan housing 32 and is disposed proximate to the steam exhaust port 32*b*, to draw steam from inside the washtub 4 and to discharge the steam from the dishwasher.

The electromagnet 38 is activated to operate the shaft 36*a*, by way of an electromagnetic force applied to the shaft, to cause the intake port cover 36 to seal the cavity during washing and rinsing steps, by blocking the steam intake port 32*a* to reduce heat loss and noise as well as preventing the spraying water from entering the steam discharger. Then, upon performing the drying step, the electromagnet 38 is deactivated to retract the shaft 36*a* and thereby cause the intake port cover 36 to open the steam intake port 32*a* so that the steam may be discharged by driving the fan motor within the fan housing.

During operation, however, the steam discharger 30 tends to fail since the electromagnet 38 cannot be protected from the steam entering through the steam intake port 32*a*. That is, while the electromagnet 38 is deactivated and the steam intake port 32*a* is open, the steam escapes through the hole 32*h* of the fan housing 32 to make contact with electromagnet's components, causing an accelerated corrosion of terminals and the like. As a result, the electromagnet of the above steam discharger, adopted for use in the dishwasher according to the related art, is subject to frequent malfunction, short-circuiting, and permanent damage. There may also be corrosive damage introduced to other conductive elements necessary for operating an electromagnet.

SUMMARY OF THE INVENTION

Accordingly, the present invention is directed to a dishwasher that substantially obviates one or more of the problems due to limitations and disadvantages of the related art.

An object of the present invention, which has been devised to solve the foregoing problem, lies in providing a dishwasher having a steam discharger, in which an intake port cover for closing a steam intake port is mechanically operated.

It is another object of the present invention to provide a dishwasher having a steam discharger, which eliminates the use of an electromagnet for operating an intake port cover of the steam discharger.

It is another object of the present invention to provide a dishwasher having a steam discharger, which improves reliability of the dishwasher.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dishwasher having a cavity, where steam is created, enclosed in part by a side and a fan motor for driving a fan via a rotational shaft, each of which are installed at an upper point of the cavity side, for generating a suction force to discharge the steam from the cavity through the upper point of the cavity side via a steam discharger. The steam discharger comprises a fan housing, enclosing the fan motor and fan, for guiding the steam discharged by an operation of the fan motor, the fan housing having a steam intake port communicating with the cavity, a steam exhaust port penetrating the cavity side, and a through-hole disposed in opposition to the steam intake port; an intake port cover, movably installed within the fan housing, for opening and closing the steam intake port of the fan housing, the intake port cover having a central shaft extending through the through-hole of the fan housing; and coupling means, linking the rotational shaft of the fan motor and the central shaft of the intake port cover, for transferring the driving force of the fan motor to the intake port cover to selectively open and close the steam intake port of the fan housing.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

A general dishwasher has a cavity, i.e., a washtub, where steam is created, which is enclosed in part by a side, i.e., a hinged door. The dishwasher according to the present invention is further provided with a fan motor for driving a fan via a rotational shaft. The fan motor, fan, and rotational shaft are each installed at an upper point of the hinged door, to generate a suction force and thereby discharge the steam from the washtub through the door via a steam discharger. The present invention is particularly directed towards the steam discharger of such a dishwasher.

Figure 1:
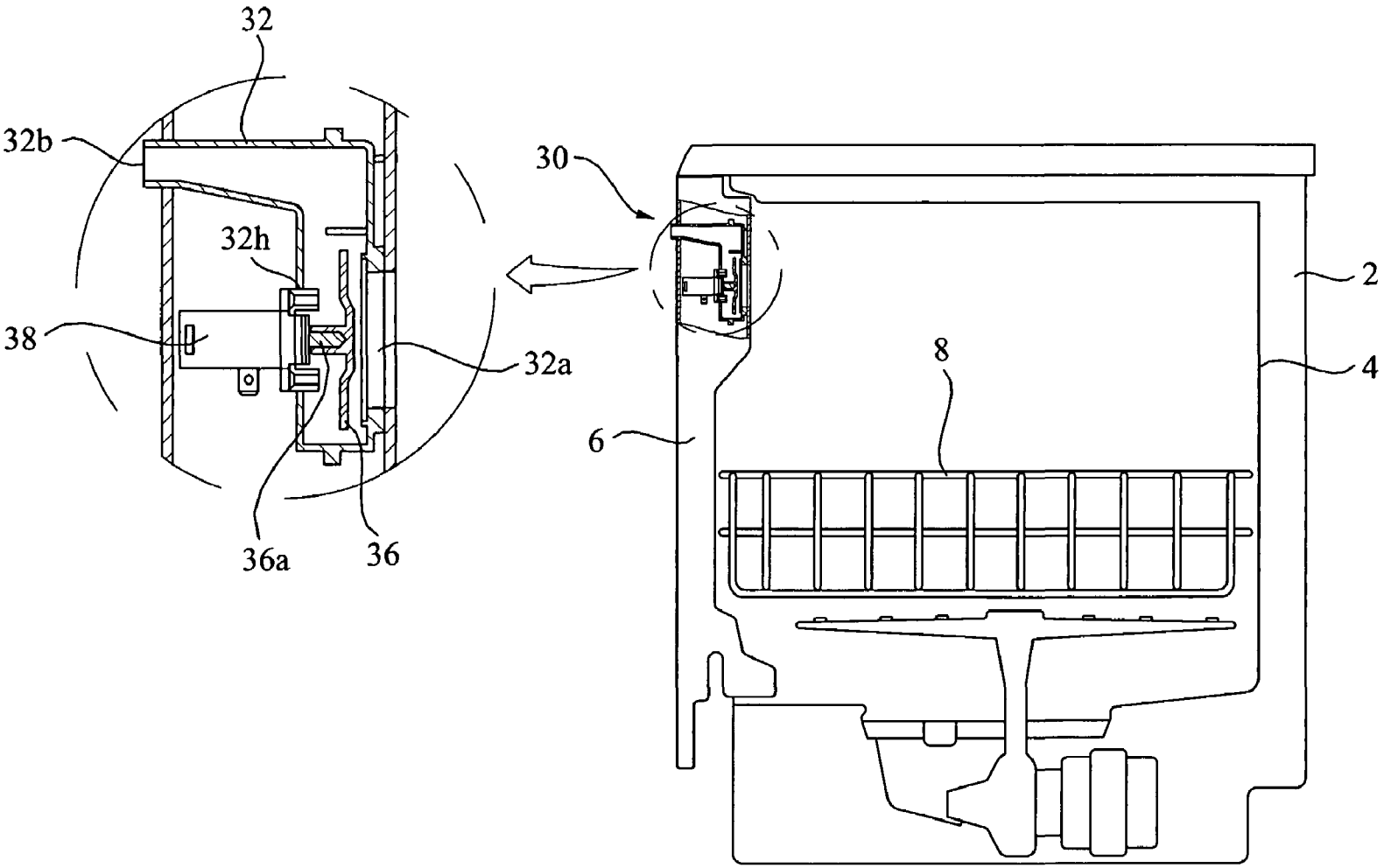
FIG. 1 Related Art
FIG. 1 is a cross-sectional view of a dishwasher according to a related art.
Figure 2:
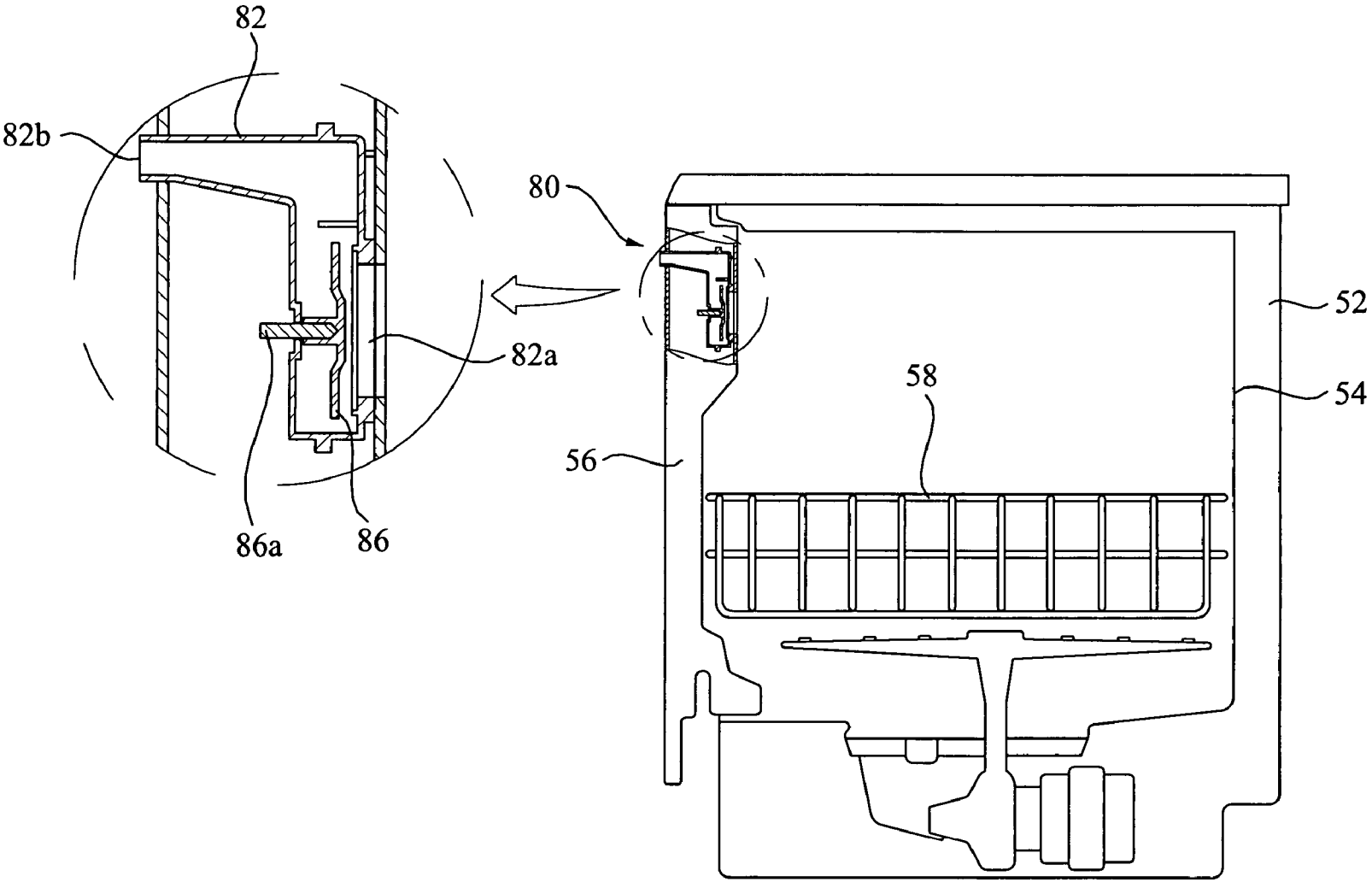
FIG. 2 is a cross-sectional view of a dishwasher having a steam discharger according to the present invention.
Figure 3:
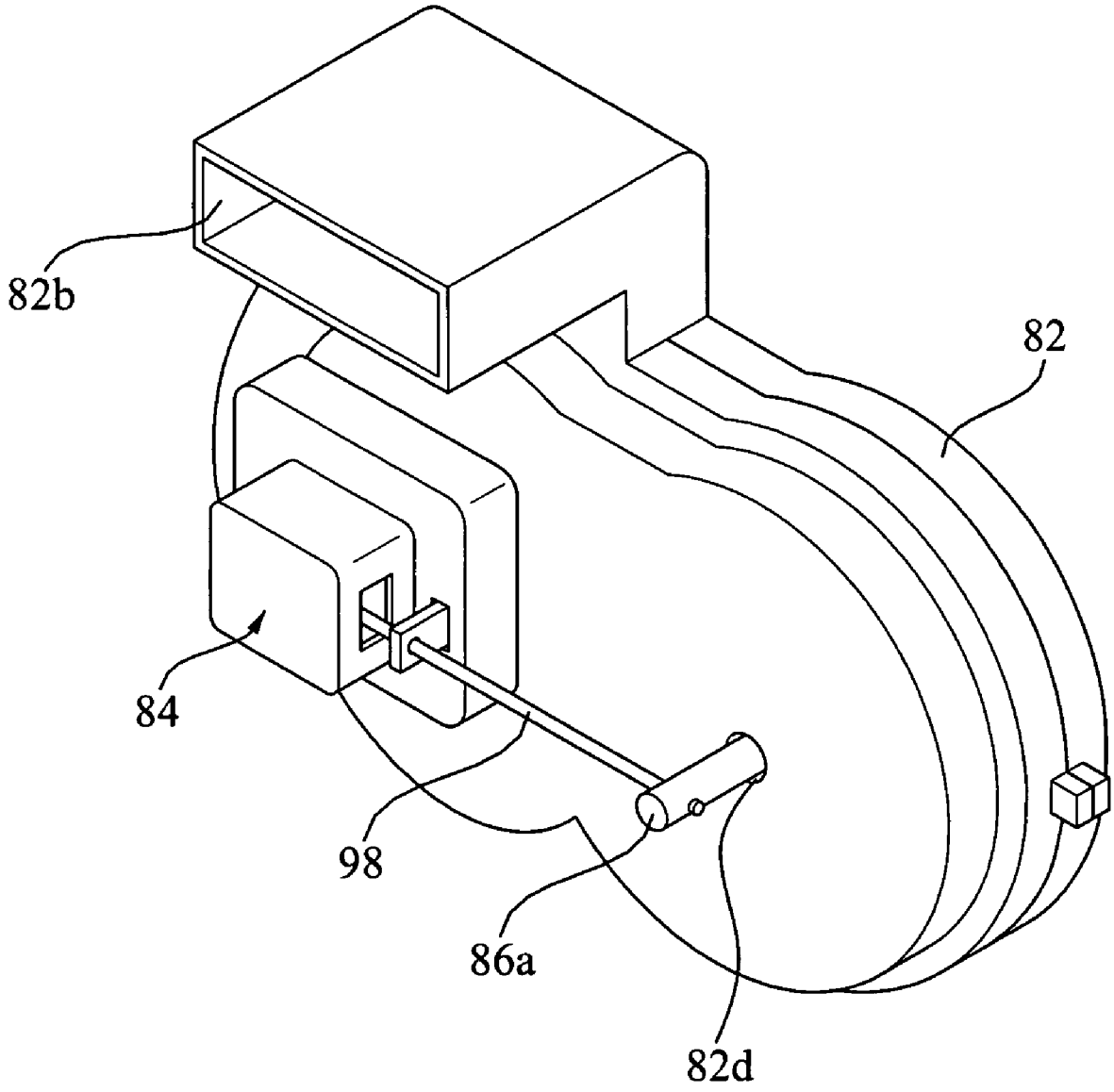
FIG. 3 is a perspective view of a mechanism for controlling an intake port cover of the dishwasher shown in FIG. 2.
Figure 4:
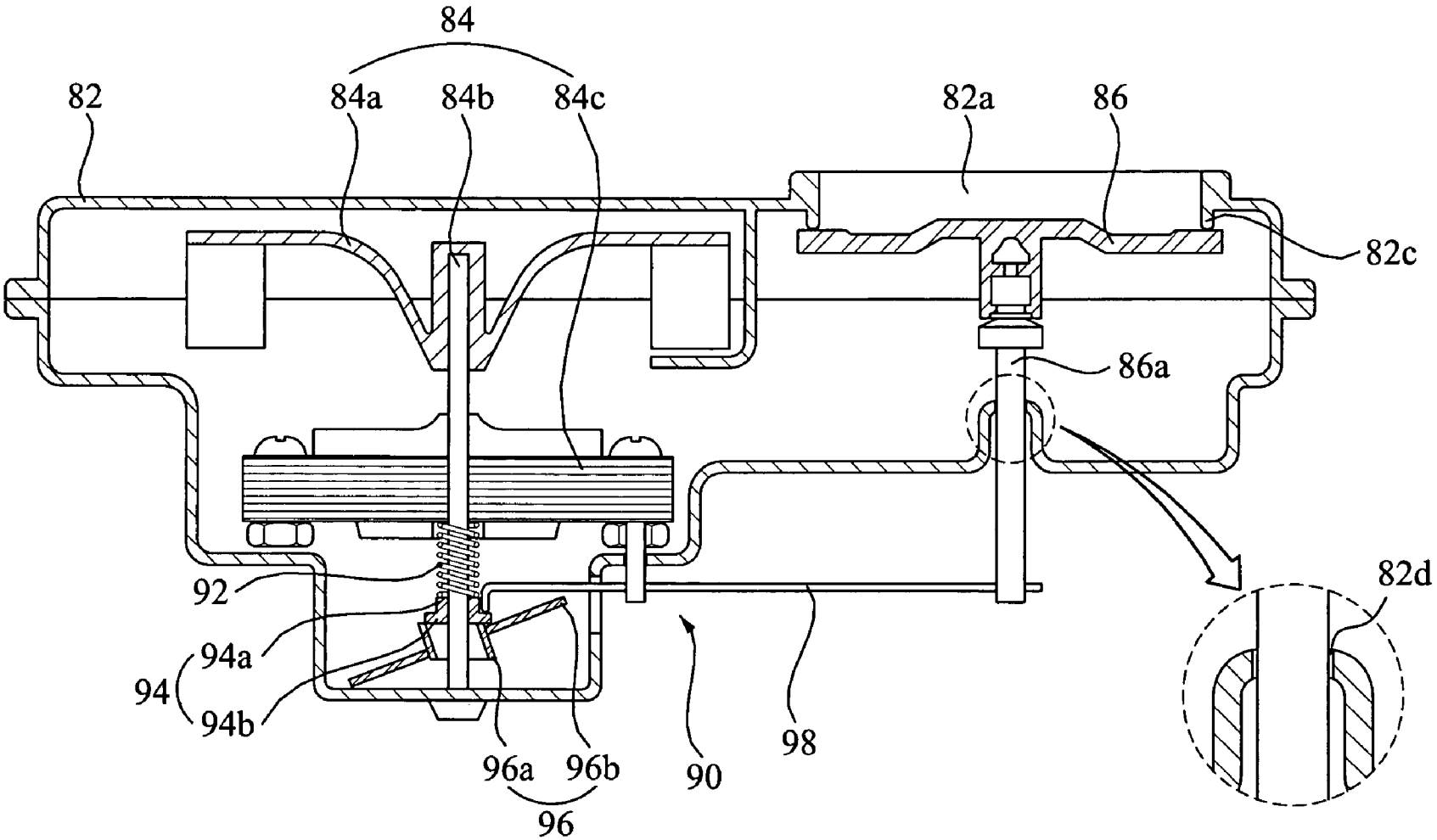
FIG. 4 is a cross-sectional view of the mechanism of FIG. 3.

Referring to FIGS. 2–4, a dishwasher according to the present invention comprises a steam discharger 80, which is typically installed between the inner and outer surfaces of a hinged door 56 installed on a front side of a body 52 encasing a washtub 54 where dishes and the like are placed on a sliding rack 58 to be washed. The stream discharger 80 comprises a fan housing 82, enclosing a fan motor assembly 84, for guiding the steam discharged by an operation of the fan motor assembly, the fan housing having a steam intake port 82*a* communicating with the cavity of the washtub 54, a steam exhaust port 82*b* penetrating the cavity side, and a through-hole 82*d* in opposition to the steam intake port; an intake port cover 86, movably installed within the fan housing, for selectively opening and closing the steam intake port of the fan housing, the intake port cover having a central shaft 86*a* extending through the through-hole of the fan housing; and coupling means 90, linking the rotational shaft of the fan motor and the central shaft of the intake port cover, for transferring the driving force of the fan motor to the intake port cover to selectively open and close the steam intake port of the fan housing. An operation of the coupling means 90 opens the steam intake port 82*a* during the performance of a drying step by the dishwasher and closes the steam intake port during the performance of washing and rinsing steps.

The fan motor assembly 84 is installed within an upper portion of the fan housing 82, to be parallel with the intake port cover 86, and includes a fan motor 84*c* for driving via a rotational shaft 84*b* and fan 84*a* to generate a suction force drawing air and steam from the steam intake port 82*a* and expelling the air and steam from the washtub 54 through the steam exhaust port 82*b*. The steam intake port 82*a* of the fan housing 82 is substantially flush with the inner surface of the door 56, and the steam exhaust port 82*b* of the fan housing preferably protrudes slightly from the outer surface of the door.

The intake port cover 86 is formed of a rubber based material to provide an airtight seal of the steam intake port 82*a*. To assist the sealing action, an annular rib 82*c*, protruding toward the intake port cover 86, is provided to an inner circumference of the steam intake port 82*a*.

The coupling means 90 comprises a spring 92, installed on an outer circumference of the rotational shaft 84*b* of the fan motor 84*c*, to be elastically supported by the fan motor; a push ring 94, installed movably along the rotational shaft of the fan motor, for compressing the spring; a push member 96, hinge-coupled with the rotational shaft of the fan motor, for pressing the push ring when the rotational shaft of the fan motor is driven; and a linking rod 98 having one end supported by the push ring, the other end coupled to a distal end of the central shaft 86*a* of the intake port cover 86, and a leverage point hinge-coupled to the fan housing 82 so that when, the push ring compresses the spring, the intake port cover opens the steam intake port 82*a*.

The push ring 94 includes a hollow body 94*a*, fitted to the rotational shaft 84*b* of the fan motor 84*c*, having one end abutting the spring 92; and an annular flange 94*b*, formed on the other end of the hollow body, the annular flange providing a first surface to catch the end of the linking rod 98 and a second surface in contact with the push member 96.

The push member 96 includes a skewed hollow shaft 96*a*, disposed at a first predetermined angle with respect to the rotational shaft 84*b* of the fan motor 84*c* and hinge-coupled to the rotational shaft at a second predetermined angle so as to movably rotate against the rotational shaft, and a pair of pivoting arms 96*b* extending perpendicularly from the circumferential surface of the skewed hollow shaft. The inner diameter dimension of the skewed hollow shaft 96*a*, which is greater than the outer diameter dimension of the rotational shaft 84*b* of the fan motor 84*c*, depends on the second predetermined angle of the skewed hollow shaft. When the rotational shaft 84*b* rotates, a centrifugal force is created in the pivoting arms 96*b* of the skewed hollow shaft 96*a*, so that the pivoting arms are brought perpendicular to the rotational shaft 84*b* of the fan motor 84*c*. Hence, an inn er lip of the skewed hollow shaft 96*a* pushes against the second surface of the annular flange 94*b*, to thereby compress the spring 92 and activate the linking rod 98.

Figure 5:
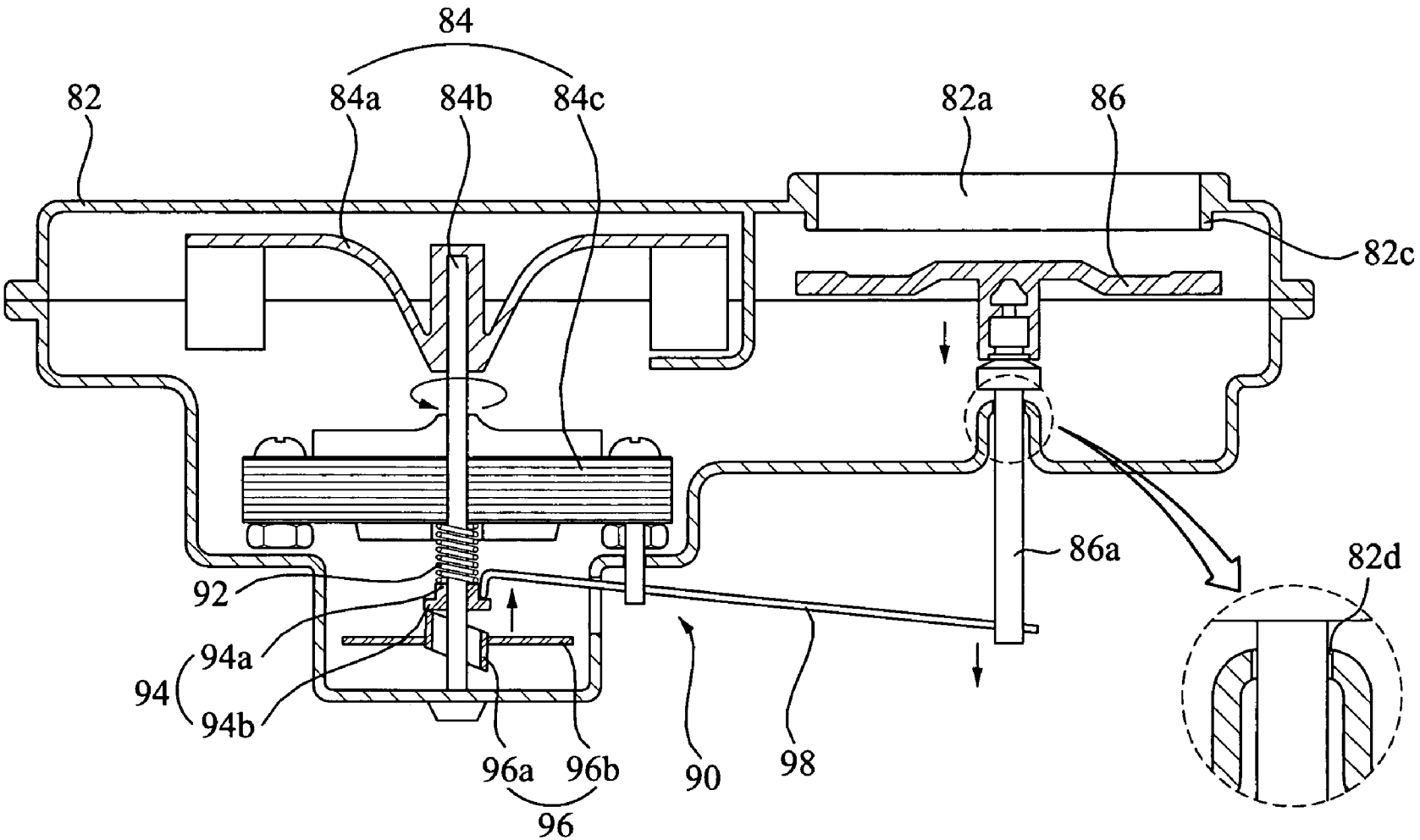
FIG. 5 is a cross-sectional view illustrating an operational status of the mechanism as shown in FIG. 4.

In the operation of the steam discharger of the present invention, the fan motor 84*c* is inactive (i.e., not driven) during the performance of washing and rinsing steps by the dishwasher. Thus, as shown in FIG. 4, the fan motor 84*c* is in stopped state, and the intake port cover 86 blocks the steam intake port 82*a*. Upon initiating the dishwasher's drying step, the fan motor 84 is actuated to rotate the fan 84*a* to expel the steam from the washtub 54 via the fan housing 82. In doing so, as shown in FIG. 5, the driving force of the fan motor 84*c* causes the intake port cover 86 to open the steam intake port 82*a* via the coupling means 90.

In detail, as the fan motor 84*c* is actuated to rotate the rotational shaft 84*b*, the skewed hollow shaft 96*a* is rotated to thereby create a centrifugal force acting on the pivoting arms 96*b*. As the pivoting arms 96*b* spin, the centrifugal force forces the pivoting arms perpendicular with the rotational shaft 84*b* of the fan motor 84*c* and in turn forces the circumferential surface of the skewed hollow shaft 96*a* parallel with the rotational shaft so that the inner lip of the skewed hollow shaft 96*a* presses the push ring 94, which compresses the spring 92. Simultaneously, one end of the linking rod 98 is set in motion by the annular flange 94*b*, so that the other end acts the central shaft 86*a* of the intake port cover 86 to open the steam intake port 82*a*. Thus, by a forcible blowing force of the fan 84*a* driven by the fan motor 84*c* via the rotational shaft 84*b*, the steam in the washtub 54 is sucked into the fan housing 82 via the steam intake port 82*a* to be expelled from the washtub through the steam exhaust port 82*b*.

Accordingly, the steam discharger of a dishwasher according to the present invention mechanically transfers power from the rotational shaft of the fan motor to the intake port cover, such that the steam intake port is opened whenever the fan motor is driven, thereby obviating an electrical activating means such an electromagnet.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dishwasher having a steam discharger, the steam discharger comprising:

a fan housing having a steam intake port in communication with a cavity of the dishwasher and a steam exhaust port which penetrates a side of the cavity, wherein the fan housing is configured to receive a fan and a fan motor therein, and to guide steam from the cavity out through the steam exhaust port;

an intake port cover movably installed within the fan housing, wherein the intake port cover is configured to open and close the steam intake port of the fan housing; and a coupler configured to link the intake port cover with a rotational shaft of the fan motor, and to transfer a driving force of the fan motor to the intake port cover so as to selectively open and close the steam intake port of the fan housing.

2. The dishwasher of claim 1, wherein the steam intake port of the fan housing is configured to be open during drying operation and to be closed during washing and rinsing operations.

3. The dishwasher of claim 1, wherein the intake port cover has a central shaft that is linked to the rotational shaft of the fan motor via the coupler.

4. The dishwasher of claim 3, wherein the fan housing includes a through-hole disposed in opposition to the steam intake port, and wherein the central shaft of the intake port cover extends through the through-hole of the fan housing so as to link to the rotational shaft of the fan motor via the coupler.

5. The dishwasher of claim 3, wherein the coupler comprises:

a spring installed on an outer circumference of the rotational shaft of the fan motor so as to be elastically supported by the fan motor;

a push ring, movably installed along the rotational shaft of the fan motor and configured to compress the spring;

a push member hinge-coupled to the rotational shaft of the fan motor and configured to press the push ring when the rotational shaft of the fan motor is driven; and a linking rod having a first end supported by the push ring, a second end coupled to a distal end of the central shaft of the intake port cover, and a leverage point hinge-coupled to the fan housing such that movement of the push ring against the bias of the spring causes the steam intake port to open.

6. The dishwasher of claim 5, wherein, when the fan motor is not rotating, and the spring is in a static state, the intake port cover closes the steam intake port.

7. The dishwasher of claim 5, wherein the push ring comprises:

a hollow body fitted over the rotational shaft of the fan motor and having a first end abutting a corresponding end of the spring; and an annular flange formed on a second end of the hollow body, wherein the annular flange includes a first surface configured to catch the first end of the linking rod and a second surface configured to contact the push member.

8. The dishwasher of claim 5, wherein the push member comprises:

a skewed hollow shaft disposed at a first predetermined angle with respect to the rotational shaft of the fan motor and hinge-coupled to the rotational shaft of the fan motor at a second predetermined angle so as to movably rotate against the rotational shaft; and a pair of pivoting arms each extending perpendicular to an outer circumferential surface of the skewed hollow shaft.

9. The dishwasher of claim 8, wherein an inner diameter dimension of the skewed hollow shaft is greater than an outer diameter dimension of the rotational shaft of the fan motor, and wherein the inner diameter dimension of the skewed hollow shaft is based on the second predetermined angle at which the skewed hollow shaft is hinge-coupled to the rotational shaft of the fan motor.

10. A dishwasher having a cavity where steam is generated, and a fan motor for driving a fan via a rotational shaft to discharge steam from the cavity, comprising:

a fan housing, enclosing the fan motor and fan, the fan housing having a steam intake port communicating with the cavity and a steam exhaust port penetrating the side of the cavity;

an intake port cover, movably installed within the fan housing, for opening and closing the steam intake port of the fan housing; and coupling means, linking the intake port cover with the rotational shaft of the fan motor, for transferring the driving force of the fan motor to the intake port cover to selectively open and close the steam intake port of the fan housing, wherein the intake port cover has a central shaft for linking with the rotational shaft of the fan motor.

11. The dishwasher of claim 10, wherein the coupling means comprises:

a push ring movably installed along the rotational shaft of the fan motor;

a push member rotatably coupled to the rotational shaft of the fan motor so as to push the push ring when the rotational shaft of the fan motor is driven; and a linking rod having a first end supported by the push ring, a second end coupled to the central shaft of the intake port cover, and a leverage point coupled to the fan housing such that axial movement of the push ring causes the intake port cover to open the steam intake port.

12. The dishwasher of claim 11, further comprising a biasing member mounted on the rotational shaft of the fan motor and configured such that axial movement of the push ring compresses the biasing member.

13. The dishwasher of claim 12, wherein the push ring comprises:

a hollow body positioned around the rotational shaft of the fan motor, with a first end thereof positioned adjacent the biasing member; and an annular flange formed on a second end of the hollow body, wherein a first surface of the annular flange is configured to engage the first end of the linking rod and a second surface of the annular flange is configured to contact the push member.

14. The dishwasher of claim 11, wherein the push member comprises;

a skewed hollow shaft rotatably coupled to the rotational shaft of the fan motor so as to rotate with respect to the rotational shaft; and a pair of pivoting arms extending perpendicularly from an outer circumferential surface of the skewed hollow shaft.

15. A dishwasher having a fan configured to discharge steam from a wash cavity of the dishwasher, comprising:

a fan housing with a steam intake port and a steam exhaust port;

a fan mounted in the housing and configured to draw steam from the cavity into the steam intake port and to exhaust steam out through the exhaust port; and an intake port cover that is configured to selectively open and close the intake port, wherein the intake port cover is coupled to the fan such that rotation of the fan causes the intake port to move to an open position.

16. The dishwasher of claim 15, further comprising a push ring mounted on a rotational shaft of the fan, wherein rotation of the fan causes the push ring to move axially along the rotational shaft, and wherein axial movement of the push ring cause the intake port cover to move between the open and closed positions.

17. The dishwasher of claim 16, further comprising a linking rod coupled between the push ring and the exhaust port cover, wherein the linking rod is configured such that axial movements of the push ring case the exhaust port cover to move between the open and closed positions.

18. The dishwasher of claim 17, further comprising a biasing member mounted on the rotational shaft of the fan and configured to bias the push ring into a closed position when the fan is not rotation.

19. The dishwasher of claim 17, further comprising a lever member coupled to the rotational shaft of the fan and configured such that when the fan operates, the lever member causes the push ring to move axially.

* * * * *